US006814008B2

(12) United States Patent
Schultz

(10) Patent No.: US 6,814,008 B2
(45) Date of Patent: Nov. 9, 2004

(54) MOUNTING DEVICE AND ASSEMBLY FOR MOUNTING A WRITING SURFACE

(75) Inventor: Neal B. Schultz, 21 Sunderland Rd., Tenafly, NJ (US) 07670

(73) Assignee: Neal B. Schultz, Tenafly, NJ (US)

( * ) Notice: Subject to any disclaimer, the term of this patent is extended or adjusted under 35 U.S.C. 154(b) by 43 days.

(21) Appl. No.: 10/339,483

(22) Filed: Jan. 9, 2003

(65) Prior Publication Data

US 2004/0134388 A1 Jul. 15, 2004

(51) Int. Cl.[7] ..... A47B 23/00
(52) U.S. Cl. ..... 108/42; 108/152; 248/250
(58) Field of Search ..... 108/42, 152, 4, 108/12; 248/235, 250

(56) References Cited

U.S. PATENT DOCUMENTS 4,984,760 A * 1/1991 Cohn et al. ..... 248/126
5,452,875 A * 9/1995 Kern ..... 248/250
5,809,933 A * 9/1998 Conwell, III ..... 248/235
6,234,328 B1 * 5/2001 Mason ..... 248/242
6,276,648 B1 * 8/2001 Katz et al. ..... 248/235
6,467,745 B1 * 10/2002 Sickels ..... 248/235
6,604,472 B2 * 8/2003 McNeil ..... 108/42
6,648,288 B2 * 11/2003 Matthes ..... 248/250

FOREIGN PATENT DOCUMENTS

GB 2236243 * 4/1991 ..... 248/250

* cited by examiner

*Primary Examiner*—Lanna Mai
*Assistant Examiner*—Hanh V. Tran
(74) *Attorney, Agent, or Firm*—Ira J. Schaefer; Hogan and Hartson, LLP

(57) ABSTRACT

A mounting device has a first member attachable to a vertical surface, a first channel for releasably receiving a planar member forming a writing surface to dispose the writing surface at a generally horizontal position and a second channel for releasably receiving the planar member to dispose the writing surface at an inclined position.

11 Claims, 4 Drawing Sheets

MOUNTING DEVICE AND ASSEMBLY FOR MOUNTING A WRITING SURFACE

BACKGROUND OF THE INVENTION

The present invention relates to a mounting device and assembly for providing a conveniently disposed writing surface.

Treatment with injection of Botulinum Toxin is an increasingly popular procedure performed to diminish or eliminate facial skin lines caused by the movement of the underlying facial muscles. One of the most common and important side effects and adverse outcomes is temporary drooping of an eyelid (blepharoptosis) which is caused by the inadvertent migration of the toxin to the upper eyelid muscle and its consequent temporary weakness or paralysis. While the cause of the ectopic migration of the toxin may be multifactorial, it is thought that failure to maintain a vertical orientation of the head in the first 2 to 4 hours immediately after treatment may contribute to it and the consequent blepharoptosis. Accordingly patients are advised to maintain a vertical orientation of their head for at least 2 hours after treatment. When patients then pay for their treatment they usually need to write a check or sign a credit card receipt, forcing them to lower their head to an angle sufficiently low to potentially increase the risk of toxin migration and consequent blepharoptosis. The present invention allows patients to comfortably execute writing and signatures without bending their head down and thereby increasing the risk of toxin migration and consequent blepharoptosis.

SUMMARY OF THE INVENTION

In accordance with the invention, a mounting device comprises a first member attachable to a vertical surface and having a first channel for releasably receiving a planar member forming a writing surface to dispose the writing surface at a generally horizontal position and a second channel for releasably receiving the planar member to dispose the writing surface at an inclined position. The mounting device is preferably an integral member, preferably composed of wood or plastic. The mounting device is preferably connected to a vertical surface by screws or a suction device.

A mounting assembly in accordance with the invention includes the mounting device and a planar member forming a writing surface which is preferably a clipboard.

DETAILED DESCRIPTION OF THE INVENTION

Figure 1:
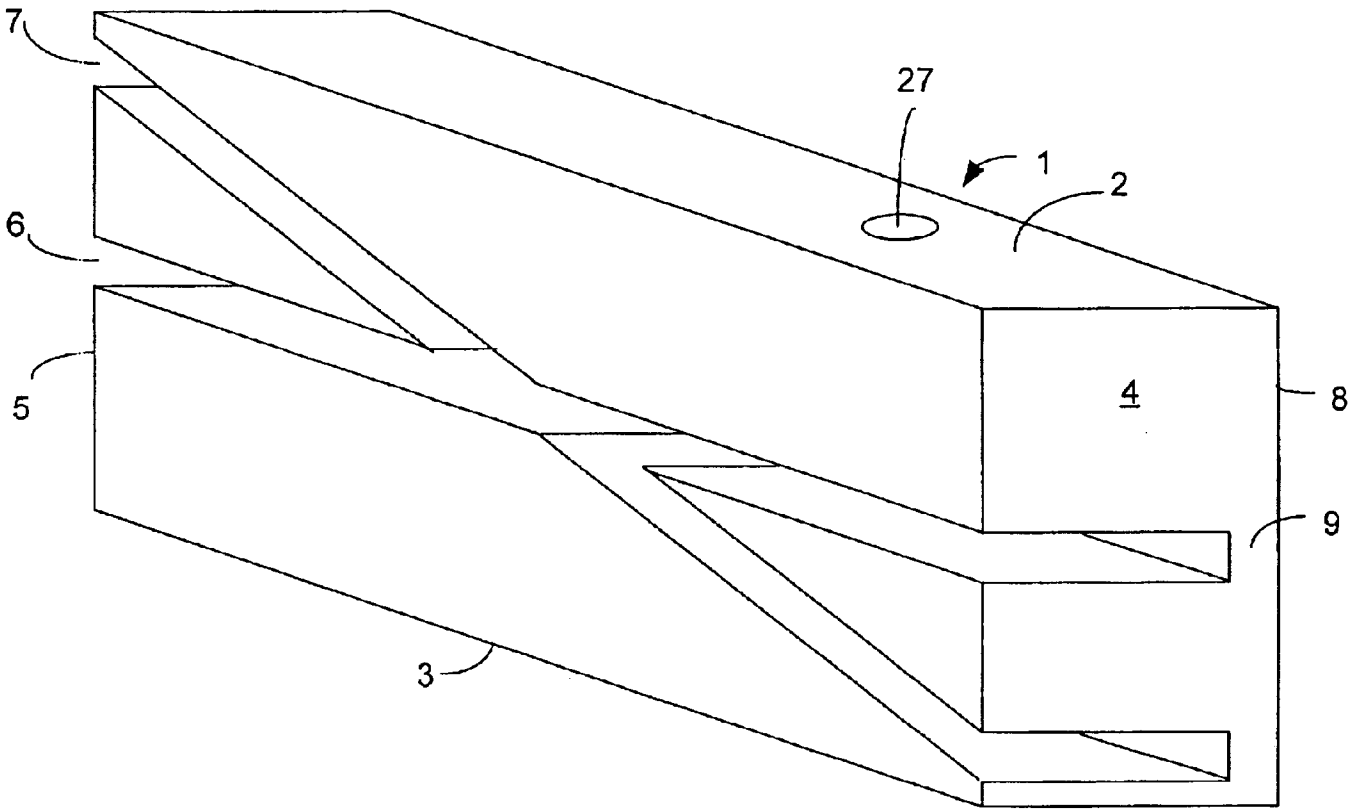
FIG. 1 is a perspective view of the mounting device according to the present invention.
Figure 5:
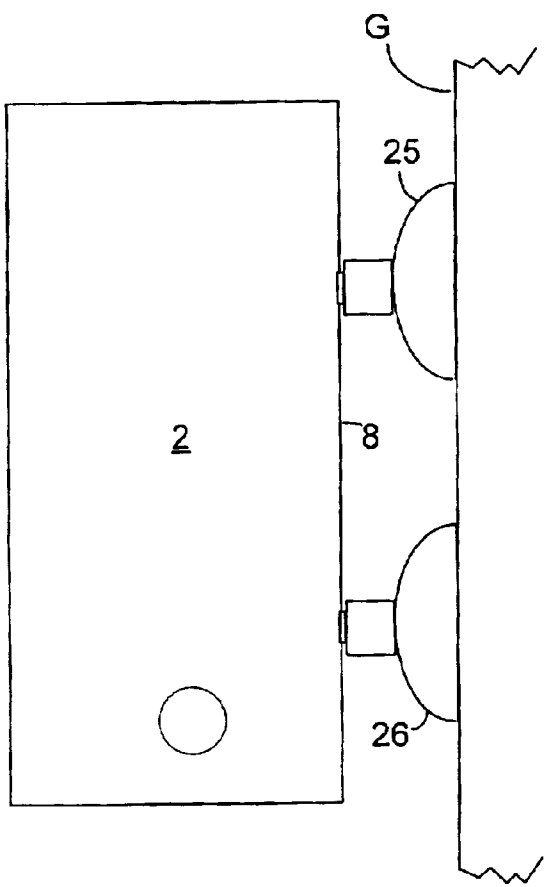
FIG. 5 shows one method of connecting the device of FIG. 1 to a glass surface.
Figure 4:
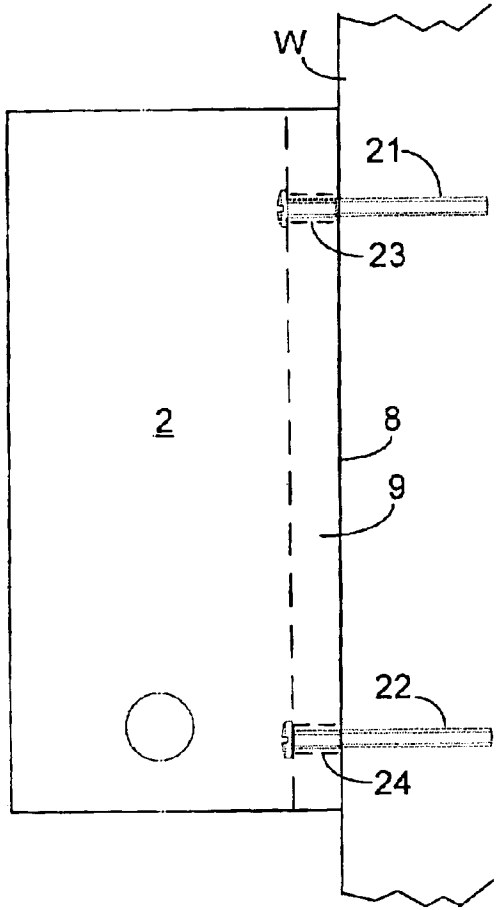
FIG. 4 shows one method of connecting the device of FIG. 1 to a wall.

Referring to FIG. 1, the mounting device 1 preferably comprises a block of wood, plastic, metal or other material which is attachable to an interior vertical surface (e.g., wall, partition, window, door, etc). The block can be attached via two screws 21, 22 which pass through predrilled holes 23, 24 to a vertical surface W as shown in FIG. 4 or by a suction device 25, 26 to a glass surface G as shown in FIG. 5.

Figure 2:
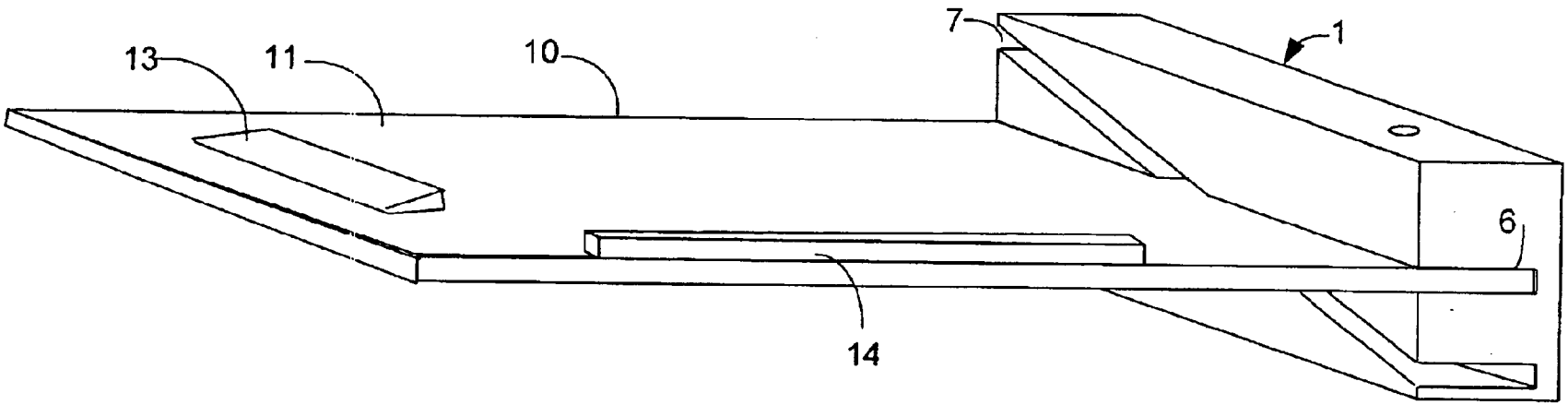
FIG. 2 is a perspective view of the mounting assembly comprising the device of FIG. 1 with a writing surface mounted thereon in a horizontal position.
Figure 3:
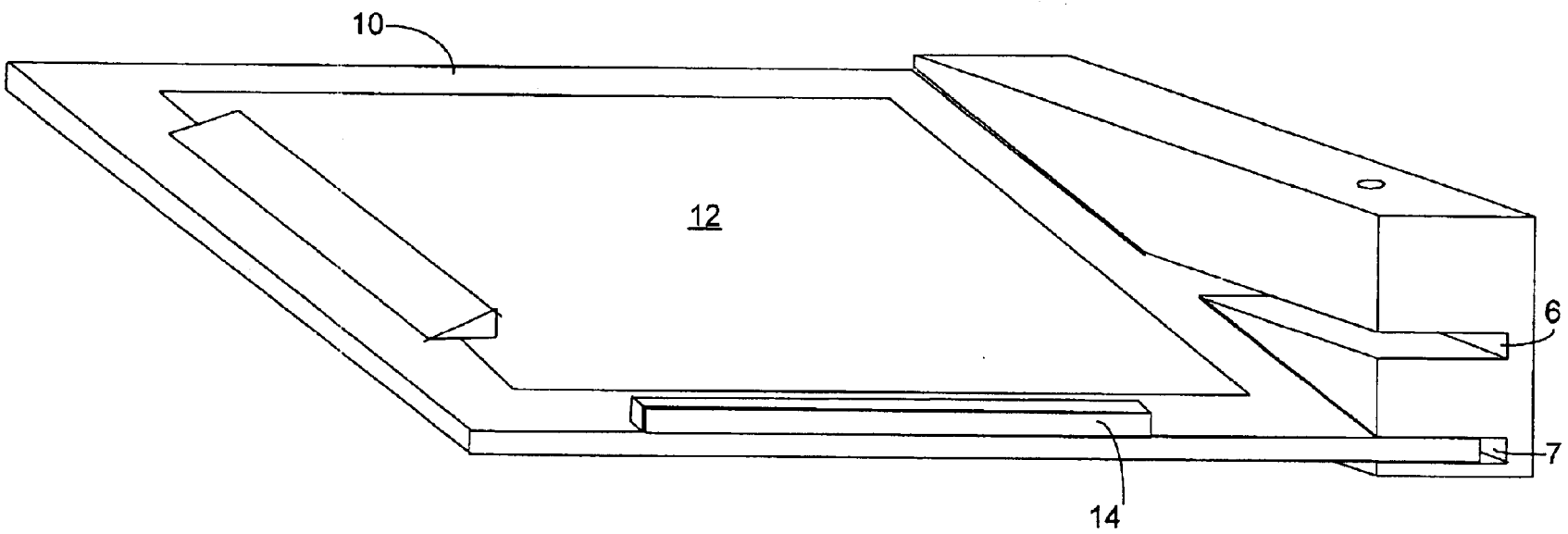
FIG. 3 is a perspective view of the mounting assembly comprising the device of FIG. 1 with a writing surface mounted thereon in an angled position.

The block has two channels 6, 7 which are configured to receive a planar member such as a clipboard 10 as shown in FIGS. 2 and 3. The channels releasably secure the clipboard during use in 1 of 2 different positions, to allow the patient to write without tilting their head down. The clipboard is easily removable after use, if desired, to be out of the way or to be aesthetically unobtrusive.

The device 1 is preferably 1⅝"×3⅝"×6" and has a top surface 2 with a pen or pencil hole 27 therein for releasably receiving a pen or pencil during use. The device has side surfaces 4, 5, bottom surface 3 and rear surface 8.

The mounting device fixedly attaches to a vertical office surface either by the two screws 21, 22 through two predrilled holes 23, 24 in the mounting block or removably by the suction devices 25, 26 if the vertical surface it is being attached to is glass. The mounting device is attached to the vertical office surface with its long sides 2, 3 parallel or substantially parallel to the floor and ceiling.

The mounting device has the two channels 6, 7, each of which allow the clipboard to be firmly held in place during its use. One channel 6 is parallel to the long sides 2, 3 of the mounting device and therefore holds the clipboard in a horizontal or substantially horizontal position as shown in FIG. 2, allowing a document to be signed to rest on the clipboard surface with no need to hold it in place. An abutment member 14 is also provided to stop a pen or pencil from rolling off the clipboard when it is at an incline as will be explained.

The other channel 7 is approximately at a 30 degree angle to the long side 3 of the block and holds the clipboard on an incline as shown in FIG. 3. When used in this position the clip 13 on the clipboard must be used to secure the paper 12 being signed so it does not slide off the clipboard. The abutment member 14 secures a pen or pencil from rolling off the inclined surface.

Each channel allows easy insertion of the planar member or clipboard into the channel by sliding the clipboard into the channel for use and then similarly easy disengagement of the clipboard after use by simply sliding the clipboard out from the channel. The channels are preferably ¼" wide and 1" deep and are perpendicular to the largest surface of the block. The channels preferably taper inwardly so as to provide a friction fit to hold the clipboard in place when it is pushed into the channel.

The channel 6 is preferably midway between the longest sides 2, 3. The other channel 7 is almost parallel to the diagonal of the front surface of the device but is angled away from the diagonal so as to not intersect the longest sides 2, 3 at the front surface of the device. The composition of the mounting block is wood, plastic or any other suitable material.

While the block is shown to be the same width as the planar member or clipboard which is ¼"×9"×6" with a 4" metal clip parallel to the short end and 1" from it, it can be larger or smaller as desired.

In use, the block is preferably mounted on a vertical surface preferably a little below the eye level of the user. It has been found that if the device positions the writing surface at approximately 4.5 feet from the ground, it will be suitable for most patients. When the writing surface is on an incline at this height, it will permit the user to see the check or credit card receipt thereon without lowering the user's head. The suction connected device has the advantage of being disposable at the exact correct height for each user, according to the user's height.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. A mounting device comprising a first member having a top surface, a front surface and a back surface;

the front surface having a substantially horizontal first channel therein for releasably receiving an edge of a planar member forming a writing surface and a second channel for releasably receiving the edge of the planar member; the second channel intersecting the first channel at a substantially acute angle, the first and second channels being open at respective front and rear ends;

the top surface having a receptacle for removably receiving a writing utensil; and wherein the back surface is attachable to a vertical surface.

2. The mounting device of claim 1 wherein the first member is an integral member.

3. The mounting device of claim 2, wherein the first member is composed of wood.

4. The mounting device of claim 2, wherein the first member is composed of plastic.

5. The mounting device of claim 1, further comprising screws for connecting the first member to a vertical surface.

6. The mounting device of claim 1, further comprising a suction device for connecting the first member to a vertical surface.

7. A mounting assembly comprising the mounting device of claim 1 and a planar member received in the first or second channel.

8. The mounting assembly of claim 7, wherein the planar member is a clipboard.

9. The mounting assembly of claim 7, the planar member has an abutment for preventing a pen from rolling off of when the planar member is at an inclined position.

10. The mounting device of claim 1 wherein a width of the front surface is substantially greater than a height of the front surface.

11. The mounting device of claim 1, wherein:

the first channel is positioned substantially halfway between the top surface and a bottom surface of the device;

the front end of the second channel is adjacent a first corner at the bottom of the front surface; and the rear end of the second channel is adjacent a second corner at the top of the front surface.

* * * * *